US006267822B1

(12) United States Patent
Watkins

(10) Patent No.: US 6,267,822 B1
(45) Date of Patent: Jul. 31, 2001

(54) METHOD FOR REMOVING MATERIAL FROM AN ELONGATED MEMBER

(75) Inventor: David K. Watkins, Brevard, NC (US)

(73) Assignee: KEIR Manufacturing, Inc., Brevard, NC (US)

( * ) Notice: Subject to any disclaimer, the term of this patent is extended or adjusted under 35 U.S.C. 154(b) by 0 days.

(21) Appl. No.: 09/385,354

(22) Filed: Aug. 30, 1999

Related U.S. Application Data

(62) Division of application No. 08/867,483, filed on Jun. 2, 1997, now Pat. No. 5,943,729.

(51) Int. Cl.[7] ..... B08B 5/04
(52) U.S. Cl. ..... 134/37; 15/309.1; 134/15
(58) Field of Search ..... 15/302, 309.1, 15/309.2; 134/15, 37

(56) References Cited

U.S. PATENT DOCUMENTS 3,044,098 * 7/1962 Stalson ..... 15/302
3,270,364 * 9/1966 Steele ..... 15/309.1
3,445,285 * 5/1969 Nast et al. ..... 134/9
3,722,077 * 3/1973 Armstrong ..... 29/527.4
3,736,618 * 6/1973 Ramsey ..... 15/309.1
4,033,785 * 7/1977 Gibbs ..... 134/15
4,064,884 * 12/1977 Asp ..... 134/15
4,287,238 * 9/1981 Stavros ..... 427/349
4,391,016 * 7/1983 Kawamura et al. ..... 15/302
4,517,024 * 5/1985 Gough ..... 134/15
4,741,113 * 5/1988 Burdick et al. ..... 15/309.1 X

* cited by examiner

*Primary Examiner*—Chris K. Moore
(74) *Attorney, Agent, or Firm*—Finnegan, Henderson, Farabow, Garrett & Dunner, L.L.P.

(57) ABSTRACT

An apparatus and method for removing material from an elongated member having known dimensions and traveling through known air densities, in which applied compressed air removes the material from the elongated member in a chamber configured to optimize the decompression and acceleration of the air.

13 Claims, 3 Drawing Sheets

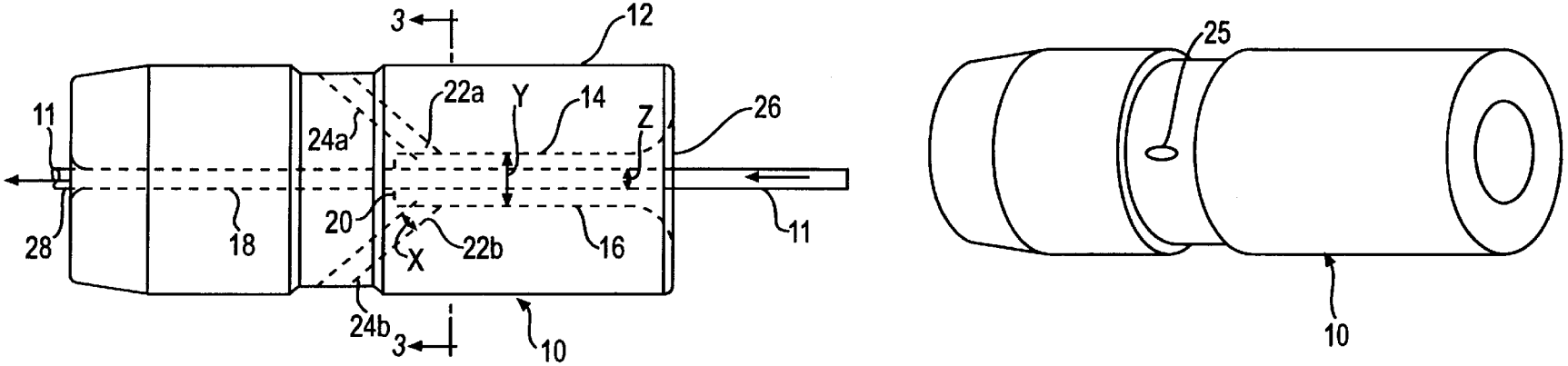
FIG. 2
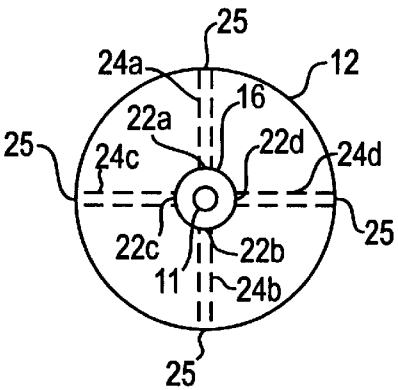
FIG. 3
FIG. 1

METHOD FOR REMOVING MATERIAL FROM AN ELONGATED MEMBER

This is a division of application Ser. No. 08/867,483, filed Jun. 2, 1997, now U.S. Pat. No. 5,943,729, issued Aug. 31, 1999.

BACKGROUND OF THE INVENTION

1. Field of Invention

The present invention relates to an apparatus and method for removing material from elongated members through the use of compressed air. This invention further relates to an airwipe device that is configured to accommodate an elongated member having a known cross-sectional area traveling through varying air pressures of known densities.

2. Description of the Prior Art

In the manufacturing of wire, or other similar elongated products, there is a need for removing liquids from the surface of the product. For example, in the production of wire cooling fluids or cleansing acids are removed from the wire prior to spooling, storage, or subsequent processing. It is known in this art to use compressed air to remove liquid from wire as it passes through a tube. Generally, compressed air is vented into the tube through tangentially directed holes and the liquid is removed by the force of the pressurized air traveling in the opposite direction of the moving wire. There have been numerous problems associated with past attempts to remove liquid from moving elongated members using such prior art methods.

Notably, air wiping devices (or "airwipes" as they are known to those skilled in this art) waste energy in attempting to remove fluid or particulate matter from a moving elongated member. This occurs largely because the tube in which the pressurized air meets or encounters the moving elongated member is the wrong size to efficiently use the available energy stored in the compressed air within close proximity to the elongated member. Similarly, the air passages that deliver the compressed air to the wire are not conventionally configured to deliver an efficient amount of compressed air based upon the cross-sectional dimensions of the elongated member and the tube. As a consequence, decompression of the air (release of energy) occurs away from the elongated member and the fluid or particulate matter is not efficiently removed.

SUMMARY OF THE INVENTION

To achieve the advantages of the invention, and in accordance with the purpose of the invention, as embodied and broadly described herein, the invention comprises the following.

A device for removing fluid from a linearly traveling elongated member that has a housing that includes a chamber with at least one air inlet for receiving compressed air into the chamber, an orifice for receiving the elongated member into the chamber, and an exit for allowing the elongated member to leave the chamber. The chamber also has axially aligned first and second chamber portions that collectively create a pathway for the elongated member to traverse through the housing. The first chamber portion is in communication with the orifice and the second chamber portion is in communication with the exit. Compressed air is vented into the first chamber portion through the air inlets and substantially onto the elongated member. The applied force of the decompressing air removes material from the elongated member and generally expels the material and air out the orifice.

Each air inlet has a cross-sectional area that is configured based upon the number of air inlets, the cross-sectional area of the first chamber portion, the cross-sectional area of the traveling elongated member, the density of the compressed air that is applied to the chamber and directed substantially onto the traveling elongated member, and the density of the air at room pressure. The cross-sectional area of each air inlet can be expressed by the following equation:

$$(\text{Area}_{air\ inlet})=[(\text{Area}_{chamber})-(\text{Area}_{elongated\ member})]\div[(N)\times(F)]$$

where $\text{Area}_{chamber}$ is the cross-sectional area of the first chamber portion, N is the number of air inlets, F is the density of the compressed air as it is delivered into the first chamber portion divided by the density of the air at room pressure, and $\text{Area}_{elongated}$ member is the cross-sectional area of the elongated member.

Another aspect of the invention is a method for removing material from a linearly traveling elongated member, which comprises the steps of delivering compressed air into a chamber through at least one air supply hole in order to direct compressed air substantially onto the elongated member to remove the material. Each air supply hole has a cross-sectional area that is approximately determined by the number of the air supply holes, the cross-sectional area of the chamber, the cross-sectional area of the elongated member, the density of the compressed air, and the density of the air at room pressure. Further, the elongated member is guided through the chamber.

Additional advantages of the invention will be set forth in part in the description which follows, and in part will be obvious from the description, or may be learned by the practice of the invention. The advantages of the invention will be realized and attained by means of the elements and combination particularly pointed out in the appended claims.

BRIEF DESCRIPTION OF THE DRAWINGS

The accompanying drawings, which are incorporated in and constitute part of the specification, illustrate various aspects of the invention and, together with a description, serve to explain the principles of the invention. In the drawings, FIG. 1 is a diagrammatic cross-section of a device that utilizes the present invention;

FIG. 2 is a perspective view of the embodiment of FIG. 1;

FIG. 3 is a cross-sectional view of FIG. 1;

DESCRIPTION OF THE PREFERRED EMBODIMENT

Figure 5:
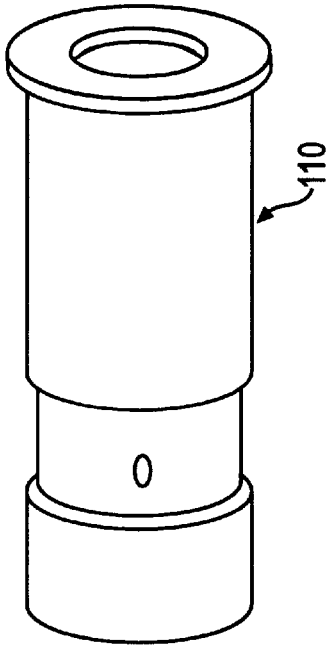
FIG. 5 is a perspective view of the embodiment of FIG. 4.

Reference will now be made to the present preferred embodiment of the invention which is illustrated in the accompanying drawings.

The device of the present invention removes particulate matter or other adherent material from an elongated member. The device will effectively remove any material loosely adhered to an elongated member such as liquids, particulate solids or combinations thereof. It shows particular utility in removing liquids from elongated solids such as wires.

In accordance with the present invention, the device includes a housing having a chamber with at least one air inlet for receiving compressed air into the chamber, an orifice for receiving an elongated member as it is traveling into the chamber, and an exit for allowing the elongated member to leave the chamber. Further, due to the design of the chamber and the direction that the compressed air is vented into the chamber and substantially onto the elongated member, the compressed air is generally expelled (with removed material) through the orifice. The chamber also has a first and second chamber portion being axially aligned with the orifice and exit.

The housing may be constructed of a polymeric material, metal or a ceramic depending upon the material being removed, the composition and properties of the elongated member being processed, as well as cost considerations. For the removal of liquid from wire, ceramic materials are preferred because of their durability and cost. Such ceramics include: alumina, silicon nitride, silicon carbide and other ceramics that can be formed into the requisite shape by compaction and sintering.

As here embodied and depicted in FIGS. 1–3, there is shown a device designated by the numeral 10. The device 10 is used to remove liquid from an elongated member 11 having a circular cross-sectional area and moving in the direction of the arrows illustrated in FIG. 1. Additionally, airwipe assembly 10 is depicted as being used in conjunction with a compressed air delivering system (not shown). Device 10 includes housing 12 having a chamber 14. Chamber 14 has two portions, a first chamber portion 16 and a second chamber portion 18, each having a separate cross-sectional area (explained more fully below) and being partially separated by shoulder member 20. Chamber 14 has four air inlets, two of which are shown as 22*a*, 22*b* in FIG. 1, and all being shown in FIG. 3 as air inlets 22*a*, 22*b*, 22*c*, 22*d*. Each air inlet 22*a*, 22*b*, 22*c*, 22*d*, provides respective passageways 24*a*, 24*b*, 24*c*, 24*d* for venting compressed air from the compressed air delivering system to chamber 14. Compressed air enters into air passageways 24*a*, 24*b*, 24*c*, 24*d* through holes 25, which are in communication with a compressed air delivery system (not shown).

The number of air inlets that are used in the device is largely driven by the composition of the airwipe and the size of the elongated member. It is generally difficult to fabricate a device made of ceramic material having a large number of holes for a small-sized elongated member. Accordingly, three or even two holes may be used in an airwipe for elongated members having diameters of approximately 0.125 inches or smaller.

As shown in FIG. 1, air passageways (e.g., 24*a*, 24*b*) are oriented in housing 12 in a diagonal fashion in order to vent compressed air substantially onto elongated member 11 when it travels through chamber 14, as well as directing the flow of compressed air and removed material toward orifice 26 in housing 12. Orifice 26 is axially aligned with first and second chamber portions 16, 18 and provides the entrance for elongated member 111 into chamber 14. Also provided in housing 12 and axially aligned with first and second chamber portions 16, 18 is an exit 28 for elongated member 111 to traverse out of chamber 14.

Further in accordance with the present invention, each air inlet has a cross-sectional area that is configured based upon the number of air inlets, the cross-sectional area of the first chamber portion, the cross-sectional area of the traveling elongated member, the density of the compressed air that is applied to the chamber and directed substantially onto the traveling elongated member, and the density of the air at room pressure. The cross-sectional area of each air inlet (one inlet diameter being depicted as "X" in FIG. 1) is determined by the following equation:

$$(\mathrm{Are}_{air\ inlet})=[(\mathrm{Area}_{chamber})-(\mathrm{Area}_{elongated\ member})]\div[(N)\times(F)]$$

where $\mathrm{Area}_{chamber}$, is the cross-sectional area of the first chamber portion (the diameter being depicted as "Y" in FIG. 1), N is the number of air inlets, F is the density of the compressed air as it is delivered into the first chamber portion divided by the density of the air at room pressure, and $\mathrm{Area}_{elongated\ member}$ is the cross-sectional area of the elongated member (the diameter being depicted as "Z" in FIG. 1).

Further, the cross-sectional area of the first chamber portion is selected based upon the cross-sectional dimensions of the elongated wire. For example, for circular wires having a diameter ranging between 0.051 to 0.125 inches, it is preferred to have a 0.030 inch gap (±0.002 inch) between the wire and the first chamber portion. In other words, for example, for wire of 0.064 inches, the first chamber portion should have a diameter of approximately 0.124 inches. The following table illustrates the preferred minimum gap size for wires of varying diameter.

| Wire Diameter | Preferred Gap Size(±0.002 in.) |
|---|---|
| 0.0–0.050 in. | 0.025 in. |
| 0.051–0.125 in. | 0.030 in. |
| 0.0126–0.200 in. | 0.040 in. |
| 0.201–0.625 in. | 0.050 in. |

It has been found that these gap sizes provide adequate space for the compressed air to decompress within close proximity to the wire in order to remove the material therefrom. It can be appreciated that varying gap sizes may be utilized depending upon the cross-sectional shapes of the elongated member, which could also include semi-flat ribbons, triangular-shaped materials, etc.

Figure 6:
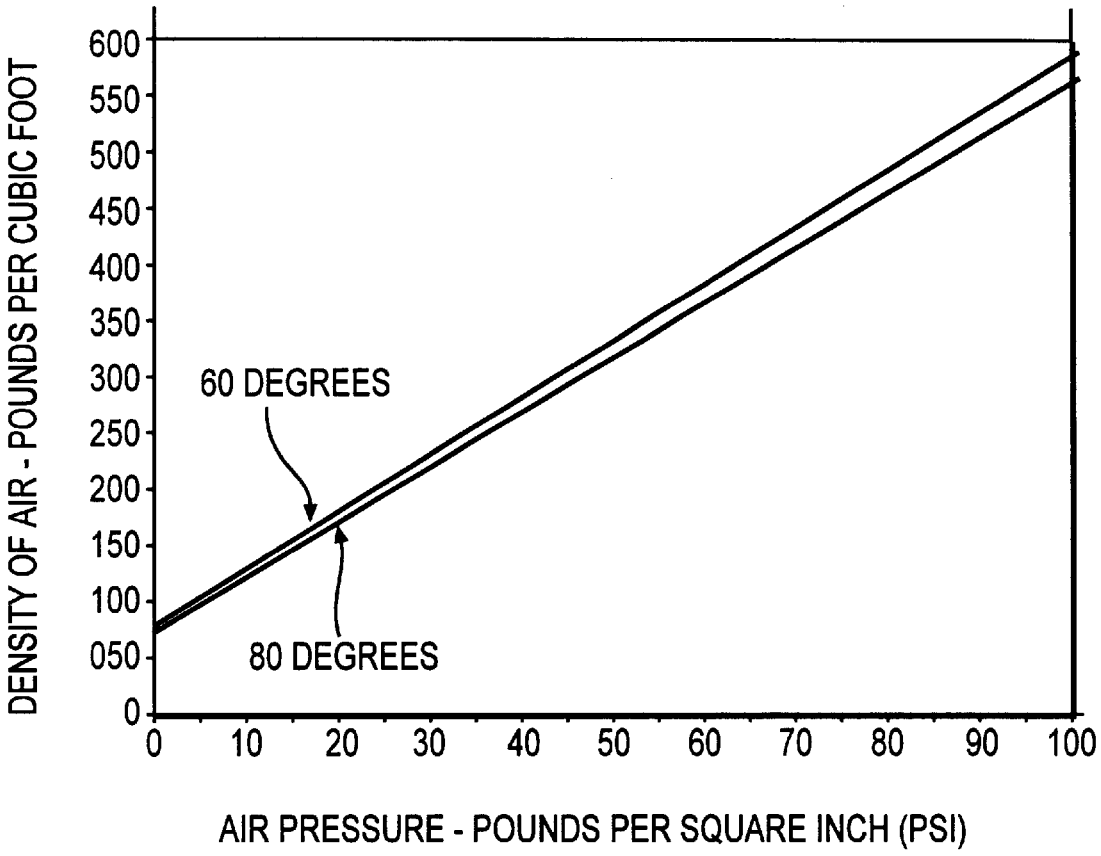
FIG. 6 is a graph demonstrating densities of air for given pressures and temperatures.

Additionally, it should be appreciated that the above referenced density values can be commonly found in a mechanics handbook or other scientific books that provide the density of air at different pressure and temperatures. FIG. 6 is a graph that demonstrates, a given air density can be determined based upon known pressure of the air (compressed or at 0.0 pounds per square inch) and at a given temperature of a manufacturing plant environment.

Further in accordance with the present invention, the second chamber portion is smaller than the first chamber portion but only slightly larger than the elongated member. As here embodied and depicted in FIG. 1, second chamber portion 18 is smaller in cross-sectional area than first chamber portion 16. Preferably, second chamber portion 18 is generally larger than elongated member 11 to the extent necessary to allow the elongated member to traverse through the second chamber portion. Typically, a 0.005 inch clearance space between elongated member 11 and second chamber portion 18 will achieve this purpose for wires up to 0.090 inches in diameter. Further, due to the configuration of the second chamber portion 18, elongated member 11 generally traverses through the center of the air flow in first chamber portion 16, and not along its surface.

Figure 4:
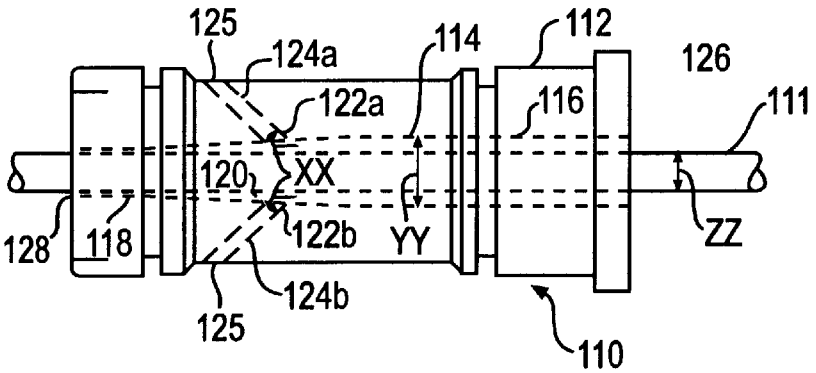
FIG. 4 is a diagrammatic cross-section of a device that utilizes the present invention.

As also embodied and depicted in FIGS. 4–5, another device is disclosed and is generally designated by the number 110. Device 110 has a housing 112 that includes a chamber 114. Chamber 114 has a first chamber portion 116 and a second chamber portion 118, each having separate cross-sectional areas and being partially separated by a narrowing region 120. Chamber 114 has four air inlets, two of which are shown as 122*a,* 122*b* in FIG. 4. Each air inlet (e.g., 122*a,* 122*b*) provides a respective air passageway (e.g., 124*a,* 124*b*) for venting compressed air from the compressed air delivering system (not shown) to chamber 114. Compressed air enters air passageways (e.g., 124*a,* 124*b*) through holes 125, which are in communication with the compressed air delivering system. Air inlets (e.g., 122*a,* 122*b*) are positioned within chamber 114 where narrowing region 120 begins to decrease in diameter size at first chamber portion 116.

Narrowing region 120 provides for a gradual decrease in cross-sectional areas of first and second chambers 116, 118 in comparison to shoulder member 20 of FIG. 1. During operation of a device using shoulder member 20, particulate or solid matter may build up on shoulder member 20 and require cleaning. Narrowing region 120, on the other hand, generally does not collect debris from elongated member 111. Accordingly, a device utilizing narrowing region 120 is preferred for this reason.

As shown in FIG. 4, air passageways (e.g., 124*a,* 124*b*) are oriented in housing 112 in a diagonal fashion in order to vent compressed air substantially along an elongated member 111 when it travels through chamber 114, as well as directing the flow of compressed air and removed fluid toward orifice 126 in housing 112. Orifice 126 is axially aligned with first and second chamber portions 116, 118 and provides the entrance for elongated member 112 into chamber 114. Also provided in housing 112 and axially aligned with first and second chamber portions 116, 118 is an exit 128 for elongated member 111 to traverse out of chamber 114.

The cross-sectional area of each air inlet (one inlet diameter being depicted as "XX" in FIG. 4) is configured using the above discussed formula and based upon the number of air inlets (e.g., 122*a,* 122*b*), the cross-sectional area of first chamber portion 116 (the diameter of which is depicted as "YY" in FIG. 4), the cross-sectional area of elongated member 111 (the diameter of which is depicted as "ZZ" in FIG. 4), the density of the compressed air that is applied to chamber 114 and directed substantially onto elongated member 111, and the density of air at room pressure. The dimensions of first and second chamber portions are selected in accordance with the same formula as was disclosed with respect to the embodiment of FIGS. 1–3.

In operation, an airwipe device is positioned along an elongated member and is also connected to a compressed air delivering system. The elongated member is fed through the orifice into the airwipe chamber and out the exit. Compressed air is vented into the chamber and substantially onto the wire through the multiple air inlets. Because the dimensions of the air inlets have been predetermined by using the above referenced formula, the compressed air efficiently expands within the chamber. The force of decompression removes particulate matter (or liquid) from the elongated member and ejects it from the orifice.

The invention recognizes that the energy available to perform the work of removing liquid or particulate matter from the elongated member is derived from the compressed air. When a controlled decompression and resulting acceleration of air flow is allowed to occur within close proximity to the elongated member, substantially all of the available energy is utilized to achieve the desired result. The invention removes various materials from elongated members effectively, without significant wear on the member or the device itself even when the materials being removed are abrasive or chemically reactive. The invention shows particular utility in removing materials such as coolants, lubricants, acids, or caustics.

The following examples illustrate the determination of an air inlet cross-sectional area, but is not to be construed as limiting the invention as described herein.

PREDICTIVE EXAMPLE NO. 1

The elongated member for this example has a circular diameter of 0.064 inches. It is presumed that the operating conditions of the manufacturing plant provides for a room temperature at 80 degree Fahrenheit, and a compressed air delivery system that supplies air at 60 pounds per square inch. Further, it is assumed that the airwipe device will have three air inlets and that the gap between the first chamber portion and the elongated member is 0.030 inches. First, the density factor of the compressed air to the room air is determined by dividing the density of the compressed air (which is 0.374 pounds per cubic feet for air at 60 psi and 80° F.) by the density of room air (which is 0.0736 pounds per cubic feet for air at 0 psi and 80° F.). For this example, the resulting density factor is approximately 5.08. Next, the cross-sectional area of the elongated member is determined by multiplying the constant II ("pie") times the square of the radius of the elongated member (0.032 inches), which approximates to 0.0032 square inches. Next, the cross-sectional area of the first chamber portion is determined by multiplying the constant II times the square of the radius of the first chamber portion (0.062 inches), which approximates to 0.0124 square inches. By applying the above referenced formula, the cross-sectional area of each air inlet is approximated to be 0.006 square inches, or rather an air inlet of 0.027 inches in diameter. Based upon these calculations, an optimal airwipe device may designed and manufactured for the given conditions.

PREDICTIVE EXAMPLE NO. 2

A single airwipe device may be designed for use with elongated members having varying diameter sizes. It is presumed that the operating conditions of the manufacturing plant provides for a room temperature at 80 degree Fahrenheit, and that the wire manufacturer would like to utilize an airwipe assembly to remove material from wires ranging in diameters from 0.032 to 0.040 to 0.051 to 0.064 to 0.081 inches. It will be further assumed that the manufacturer has the capacity to supply compressed air to the airwipe device at varying pressures, and may regulate the delivered pressure from 60 to 90 pounds per square inch. The following demonstrates an aspect of the invention to optimize an airwipe assembly to accommodate these conditions.

By design choice, the airwipe device will have three air inlets, as well as a gap between the first chamber portion and the wire of 0.030 inches. Next, the first chamber portion diameter and each air inlet diameter are selected based upon a given wire diameter and standard operating pressure; here, the largest wire diameter will be the reference point, as well will it be assumed that the air compressor will normally operate at 60 psi. Thus, the first chamber portion will have a diameter of 0.141 inches. Next, each air inlet cross-sectional area is determined by using the above referenced formula, which approximates to 0.0021 square inches, or a diameter of 0.030 inches.

As smaller wires traverse through the airwipe device, the operator of the air compressor can increase the supplied pressure in order to optimize the force to remove adherent material. As the following table demonstrates, the air pressure should varying depending on the wire size.

AIR PRESSURE NEEDED
When First Expansion Chamber & Air Supply Holes are Constant Size

| Wire Diameter | Diameter of Air Inlet | Diameter of First Expansion Chamber | $Area_{elongated\ member}$ | $Area_{chamber}$ | $Area_{air\ inlet}$ | Expansion Factor "F" | Air Supply |
|---|---|---|---|---|---|---|---|
| 0.081 in. | 0.030 in. | 0.141 in. | 0.0052 in.$^2$ | 0.0156 in.$^2$ | .0007 in.$^2$ | 5.08 | 60.0 psi |
| 0.064 in. | 0.030 in. | 0.141 in. | 0.0032 in.$^2$ | 0.0156 in.$^2$ | .0007 in.$^2$ | 6.02 | 73.9 psi |
| 0.051 in. | 0.030 in. | 0.141 in. | 0.0020 in.$^2$ | 0.0156 in.$^2$ | .0007 in.$^2$ | 6.59 | 82.4 psi |
| 0.040 in. | 0.030 in. | 0.141 in. | 0.0013 in.$^2$ | 0.0156 in.$^2$ | .0007 in.$^2$ | 6.97 | 88.1 psi |
| 0.032 in. | 0.030 in. | 0.141 in. | 0.0008 in.$^2$ | 0.0156 in.$^2$ | .0007 in.$^2$ | 7.19 | 91.3 psi |

In another aspect and in accordance with the present invention as embodied and broadly described herein, a method is disclosed for removing material from a linearly traveling elongated member, which comprises the steps of delivering compressed air into a chamber through at least one air supply hole in order to direct compressed air substantially onto the elongated member to remove the material. Each air supply hole has a cross-sectional area that is approximately determined by the number of the air supply holes, the cross-sectional area of the airwipe chamber, the cross-sectional area of the elongated member, the density of the compressed air, and the density of the air room pressure. Further, the elongated member is guided through the airwipe chamber.

It will be apparent to those skilled in the art that various modifications and variations can be made in the above-described embodiments of the present invention without departing from the scope and spirit of the invention. Thus, it is intended that the present invention covers such modifications and variations provided they come within the scope of the appended claims and their equivalents.

What is claimed:

1. A method for removing fluid from a linearly traveling elongated member, comprising the steps of:

(a) delivering compressed gas into a chamber through at least one gas inlet hole and directing the compressed gas onto the elongated member;

(b) subjecting the elongated member to the compressed gas in the chamber;

(c) controlling pressure of the compressed gas delivered to the chamber such that:

$Area_{gas\ inlet}=\{(Area_{chamber})-(Area_{elongated\ member})\}+\{(N)\times(F)\}$, where $Area_{gas\ inlet}$ is the cross-sectional area of each the gas inlet to the chamber $Area_{chamber}$ is the cross-sectional area of the chamber, $Area_{elongated\ member}$ is the cross-sectional area of the elongated member, N is the number of gas inlets to the chamber, and F is the density of the compressed gas as it is delivered into the chamber divided by the density of the gas at room pressure; and (d) guiding the elongated member through the chamber.

2. The method of claim 1, wherein the step of subjecting the elongated member to the compressed gas includes receiving the elongated member into the chamber through an orifice, delivering the gas and fluid out of the chamber, and allowing the elongated member to leave the chamber through an exit.

3. The method of claim 2, wherein the step of subjecting the elongated member to the compressed gas includes subjecting the elongated member to the compressed gas in a first chamber portion and a second chamber portion smaller than the first chamber portion.

4. The method of claim 3, wherein the step of subjecting the elongated member to the compressed gas includes subjecting the elongated member to the compressed gas in the first chamber portion and the second chamber portion separated by a tapered portion gradually tapering from a diameter of the first chamber portion to a diameter of the second chamber portion.

5. The method of claim 4, wherein the delivering step includes delivering the compressed gas via the gas inlet hole joining the chamber at the tapered portion.

6. The method of claim 2, wherein the step of subjecting the elongated member to the compressed gas includes providing a gap separating the elongated member and a wall defining the chamber.

7. The method of claim 6, wherein the step of subjecting the elongated member to the compressed gas includes providing a gap of 0.025 (±0.002) inches when the elongated member has a diameter less than 0.050 inches.

8. The method of claim 6, wherein the step of subjecting the elongated member to the compressed gas includes providing a gap of 0.030 (±0.002) inches when the elongated member has a diameter in the range between 0.051 through 0.125 inches.

9. The method of claim 6, wherein the step of subjecting the elongated member to the compressed gas includes providing a gap of 0.040 (±0.002) inches when the elongated member has a diameter in the range between 0.126 through 0.200 inches.

10. The method of claim 6, wherein the step of subjecting the elongated member to the compressed gas includes providing a gap of 0.050 (±0.002) inches when the elongated member has a diameter in the range between 0.201 through 0.625 inches.

11. The method of claim 1, wherein the delivering step includes delivering compressed air.

12. The method of claim 11 wherein the delivering step includes the chamber having an orifice at one end for receiving the elongated member into the chamber and delivering air and material out of the chamber, and an exit for allowing the elongated member to leave the chamber.

13. The method of claim 1, wherein the step of controlling pressure includes the step of allowing the gas to efficiently decompress and accelerate to remove said fluid from said elongated member.

* * * * *

UNITED STATES PATENT AND TRADEMARK OFFICE

CERTIFICATE OF CORRECTION

PATENT NO. : 6,267,822 B1
DATED : July 31, 2001
INVENTOR(S) : David K. Watkins

It is certified that error appears in the above-identified patent and that said Letters Patent is hereby corrected as shown below:

Column 7, claim 1,
Line 47, "+" should read -- ÷ --
Line 51, insert "," after "chamber"

Signed and Sealed this

Twenty-ninth Day of January, 2002

*Attest:*

*Attesting Officer*

JAMES E. ROGAN
*Director of the United States Patent and Trademark Office*